US009028278B2

(12) United States Patent
Kanda et al.

(10) Patent No.: US 9,028,278 B2
(45) Date of Patent: May 12, 2015

(54) SHIELD CONNECTOR

(71) Applicant: Yazaki Corporation, Minato-ku, Tokyo (JP)

(72) Inventors: Hidenori Kanda, Makinohara (JP); Koji Miyawaki, Susono (JP)

(73) Assignee: Yazaki Corporation, Tokyo (JP)

( * ) Notice: Subject to any disclaimer, the term of this patent is extended or adjusted under 35 U.S.C. 154(b) by 14 days.

(21) Appl. No.: 13/727,957

(22) Filed: Dec. 27, 2012

(65) Prior Publication Data

US 2013/0171873 A1 Jul. 4, 2013

(30) Foreign Application Priority Data

Dec. 28, 2011 (JP) ..... 2011-289305

(51) Int. Cl.

| | |
|---|---|
| ***H01R 9/03*** | (2006.01) |
| ***H01R 13/6581*** | (2011.01) |
| ***H01R 13/6474*** | (2011.01) |
| ***H01R 24/44*** | (2011.01) |
| *H01R 9/05* | (2006.01) |
| *H01R 13/213* | (2006.01) |

(52) U.S. Cl.

CPC ..... *H01R 13/6581* (2013.01); *H01R 9/0518* (2013.01); *H01R 13/213* (2013.01); *H01R 13/6474* (2013.01); *H01R 24/44* (2013.01)

(58) Field of Classification Search

CPC ... H01R 24/44; H01R 13/6474; H01R 13/213
USPC ..... 439/607.51, 578, 585, 595, 579, 750, 439/394

See application file for complete search history.

(56) References Cited

U.S. PATENT DOCUMENTS

| | | | | |
|---|---|---|---|---|
| 3,660,805 | A * | 5/1972 | McDonough | 439/585 |
| 4,031,614 | A * | 6/1977 | Gipe | 29/879 |
| 6,083,034 | A * | 7/2000 | Kameyama | 439/394 |
| 6,200,162 | B1 * | 3/2001 | Aoyama et al. | 439/578 |
| 6,210,223 | B1 | 4/2001 | Aoyama et al. | |
| 6,217,379 | B1 * | 4/2001 | D'Hulster et al. | 439/752.5 |
| 8,011,954 | B2 * | 9/2011 | Nagafuchi | 439/585 |
| 2005/0287875 | A1 * | 12/2005 | Kojima | 439/750 |
| 2006/0160419 | A1 * | 7/2006 | Wang | 439/579 |
| 2010/0035449 | A1 * | 2/2010 | Nagafuchi | 439/98 |

FOREIGN PATENT DOCUMENTS

| | | | |
|---|---|---|---|
| JP | 2006-24499 | A | 1/2006 |
| JP | 2011-034773 | A | 2/2011 |
| JP | 2011-065882 | A | 3/2011 |

OTHER PUBLICATIONS

Communication dated Sep. 23, 2014 from the State Intellectual Property Office of the People's Republic of China in counterpart application No. 201210575026.X.

* cited by examiner

*Primary Examiner* — Jean F Duverne
(74) *Attorney, Agent, or Firm* — Sughrue Mion, PLLC

(57) ABSTRACT

An inner terminal is provided with a crimp barrel portion with which a terminal of a core wire is connected and an electric connecting portion to be electrically connected with a mating terminal. The inner terminal is received in an insulation inner housing. The inner housing is set into a terminal body portion. An outer terminal is provided with a shield member connecting portion with which a shield member is connected and a cylindrical portion in which the electric connecting portion of the inner terminal is positioned, the cylindrical portion mated with a mating connector. An impedance adjusting portion is provided between the electric connecting portion and the crimp barrel portion of the inner terminal.

6 Claims, 9 Drawing Sheets

SHIELD CONNECTOR

CROSS-REFERENCE TO RELATED APPLICATIONS

This application claims the priority of Application No. JP 2011-289305 filed Dec. 28, 2011, in the Japanese Patent Office (JPO), the disclosures of which are incorporated herein in their entirety.

BACKGROUND OF THE INVENTION

1. Field of Invention

The present invention relates to a shield connector capable of easily making an adjustment with impedance of a shield electric cable connected with the shield connector.

2. Description of the Related Art

A shield electric cable is used for transmitting a high frequency signal to a control board of an electric apparatus such as a vehicular television, radio, and navigation system. This shield electric cable is a coaxial cable formed by a core wire made by twining together a plurality of wires, a shield member made of braided wires which cover an outer periphery of the core wire via an inner cover made of insulation, and an outer cover made of insulation which covers an outer periphery of the shield member.

The shield connector is used for connecting the above electric cables with each other. The shield connector is formed by an inner terminal connected to the core wire of the shield electric cable, an outer terminal connected to the shield member of the shield electric cable, and an inner housing receiving therein the inner terminal.

The inner housing is made of an insulation resin and incorporated into the outer terminal in a state of receiving the inner terminal in the inner housing. A distal end side of an inner terminal of a mating connector side is inserted into the inner housing incorporated into the outer terminal, thus bringing the inner terminal in the inner housing into contact with the inner terminal of the mating connector and into electrical connection.

The outer terminal has a cylindrical portion for receiving therein the inner housing in a covered state and a shield member connecting portion so crimped as to cover the shield member of the shield electric cable from the outer peripheral side thus fixing the shield member. Further, in the outer terminal, a terminal body portion for crimping and fixing the inner housing is formed between the cylindrical portion and the shield member connecting portion. In the above outer terminal, the cylindrical portion covers an outer periphery of the inner housing, and the shield member connecting portion covers the outer periphery of the shield member of the shield electric cable, thus allowing the terminal body portion to crimp and fix the inner housing between the cylindrical portion and the shield member connecting portion.

A conventional shield connector is disclosed in Japanese Patent Unexamined Publication No. 2011-34773 (Patent Literature 1) and Japanese Patent Unexamined Publication No. 2011-65882 (Patent Literature 2).

SUMMARY OF THE INVENTION

In the conventional shield connector, the cylindrical portion of the outer terminal covers the inner housing and the shield member connecting portion covers the shield member of the shield electric cable, while the terminal body portion between the cylindrical portion and the shield member connecting portion does not sufficiently cover the inner housing.

Thus, constitutionally, an open portion not sufficiently covered is caused to a connecting portion between the cylindrical portion and the shield member connecting portion. In the open portion, impedance is locally enhanced to thereby disorder the impedance, thus leading to deterioration of the high frequency performance of the signal transmitted by the shield electric cable. For preventing the deterioration of the high frequency signal, it is necessary to cover the connecting portion with an outer cover and the like. Due to this, parts as the shield connector should be added. This causes such problems as to increase the number of parts as well as to inconvenience assembling of the shield connector.

It is an object of the present invention to provide a shield connector that can improve the high frequency performance by enabling adjusting of the impedance with the shield electric cable without additional parts.

A first aspect of the present invention provides a shield connector to be connected to an end of a shield electric cable having a core wire covered with a shield member via insulation, the shield connector comprising: an inner terminal including a crimp barrel portion with which an end of the core wire is connected and an electric connecting portion to be electrically connected with a mating terminal; an insulation inner housing to receive therein the inner terminal; an outer terminal including a terminal body portion into which the inner housing is set with the inner terminal received in the inner housing, a shield member connecting portion with which the shield member is connected, and a cylindrical portion in which the electric connecting portion of the inner terminal is positioned, the cylindrical portion mated with a mating connector; and an impedance adjusting portion is provided between the electric connecting portion and the crimp barrel portion of the inner terminal.

The inner housing may be formed with a receiving recess portion to receive the inner terminal, and the receiving recess portion may be formed with a mating groove portion, thereby enabling to position the inner terminal in the inner housing by mating the impedance adjusting portion with the mating groove portion.

The impedance adjusting portion may be formed with a bottom plate portion continuous with the electric connecting portion and with the crimp barrel portion, and side plate portions rising from respective side portions of the bottom plate portion.

According to the first aspect of the present invention, in the inner terminal, the impedance adjusting portion is provided between the electric connecting portion to be electrically connected with the mating terminal and the crimp barrel portion with which the end of the core wire is connected, so that the impedance of the entirety of the shield connector can be adjusted on the inner terminal side. This adjusting suppresses the disorder of the impedance, thus enabling to improve the high frequency performance of the signal transmitted by the shield electric cable. With the above structure, the inner terminal suppresses the disorder of the impedance, which dispenses with other additional parts for suppressing the disorder of the impedance and increase of the number of parts, thus facilitating assembling of the shield connector.

Further, when the inner terminal is to be received in the inner housing, the impedance adjusting portion of the inner terminal is mated with the mating groove portion of the inner housing. This enables to easily position the inner terminal to the inner housing as well as to reliably fix the inner terminal to the inner housing.

Further, forming the bottom plate portion and the side plate portions at the impedance adjusting portion brings about a structure allowing the impedance adjusting portion to reliably cover the core wire of the shield electric cable, thus enabling to easily suppress the disorder of the impedance. Further, the bottom plate portion of the impedance adjusting portion is continuous with the electric connecting portion and the crimp barrel portion, thus enabling to easily form the impedance adjusting portion at the inner terminal.

DESCRIPTION OF THE EMBODIMENT

Figure 1:
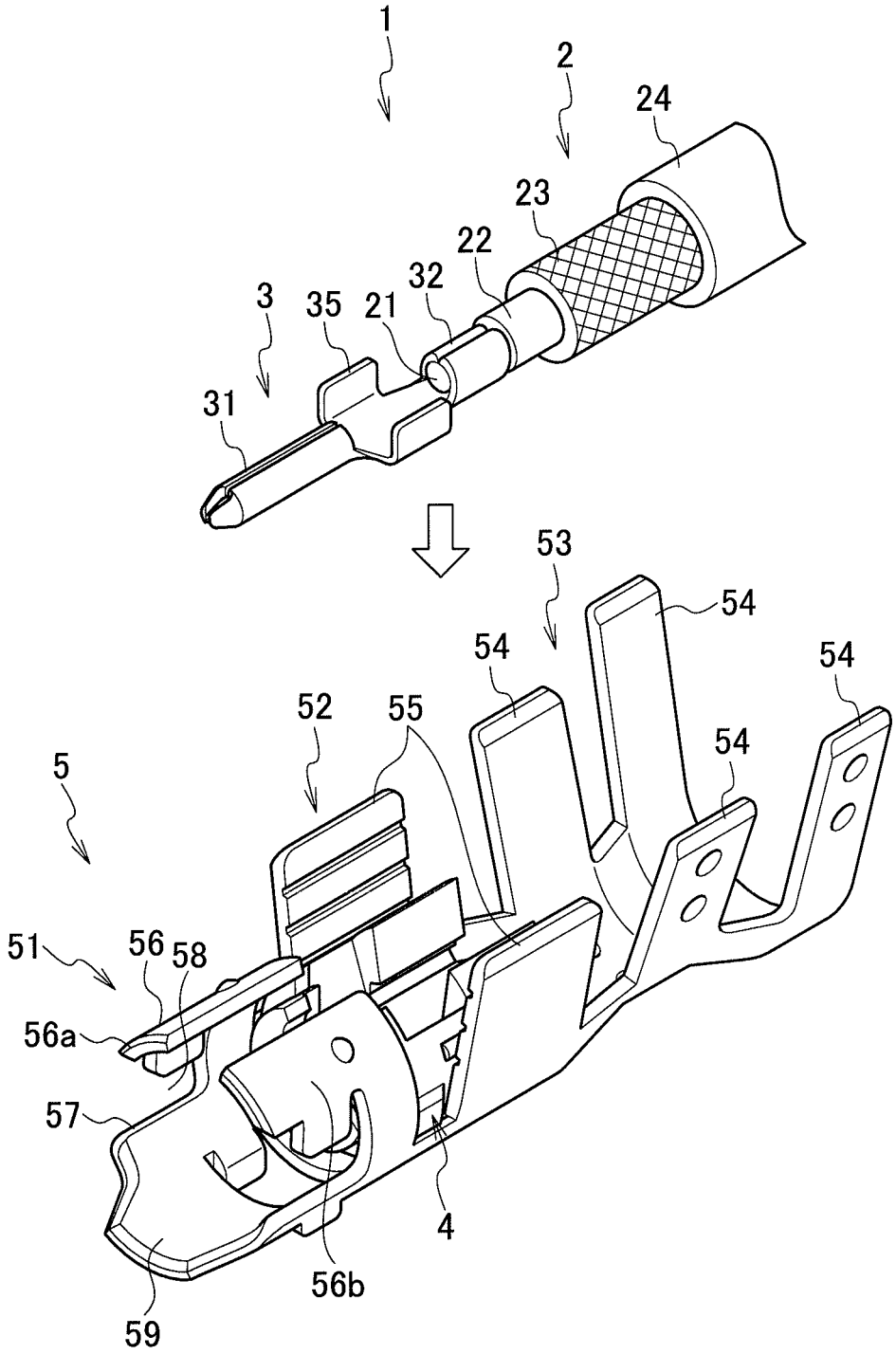
FIG. 1 is a perspective view showing an assembling state of a shied connector according to one embodiment of the present invention.
Figure 10:
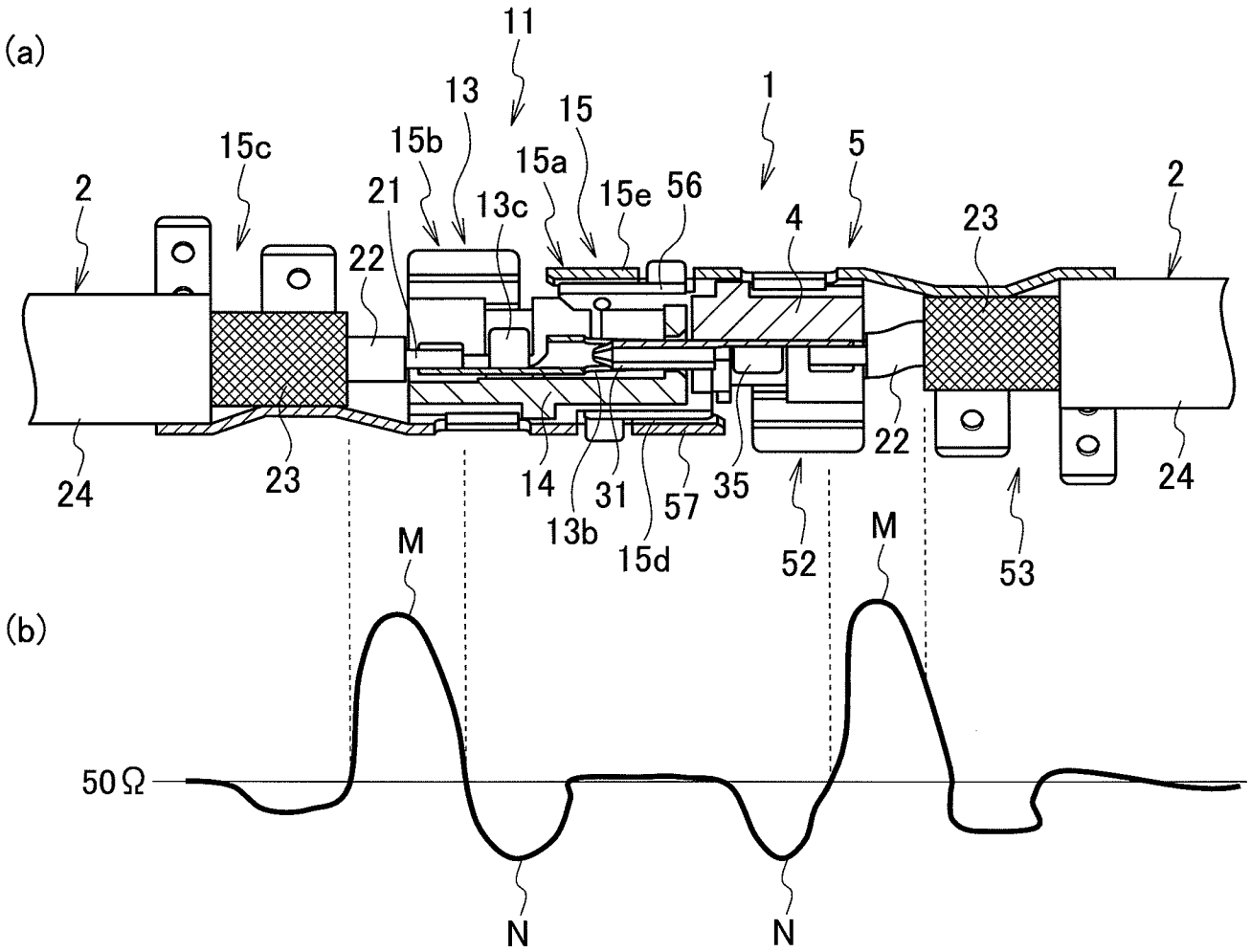
FIG. 10(*a*) is a cross sectional view showing a state in which the shield connector is connected with the mating connector and FIG. 10(*b*) is a graph showing an impedance characteristic responding to FIG. 10(*a*), according to the one embodiment of the present invention.

As shown in FIG. 1, a shield electric cable 2 is connected to a shield connector 1. As shown in FIG. 1 and FIG. 10, the shield electric cable 2 has a coaxial structure formed by: a central core wire 21 formed by twining together a plurality of conductive wires; an inner cover 22 made of an insulation resin and so provided as to cover an outer periphery of the core wire 21; a shield member 23 made of conductive braided wires and so provided as to cover an outer periphery of the inner cover 22; and an outer cover 24 made of an insulation resin and so provided as to cover an outer periphery of the shield member 23. Of these, the core wire 21 transmits a high frequency signal, and the shield member 23 shields an electromagnetic wave. With the shield member 23 exposed by peeling off the outer cover 24 and the core wire 21 exposed by peeling off the inner cover 22, the above shield electric cable 2 is used for connection with the shield connector 1.

As shown in FIG. 1 and FIG. 10, the shield connector 1 is formed by an inner terminal 3, an inner housing 4 and an outer terminal 5. The entirety of each of the inner terminal 3 and the outer terminal 5 is formed by a conductive metal and the inner housing 4 is formed by an insulation resin. The core wire 21 of the shield electric cable 2 is connected with the inner terminal 3 and the shield member 23 of the shield electric cable 2 is connected with the outer terminal 5.

Figure 2:
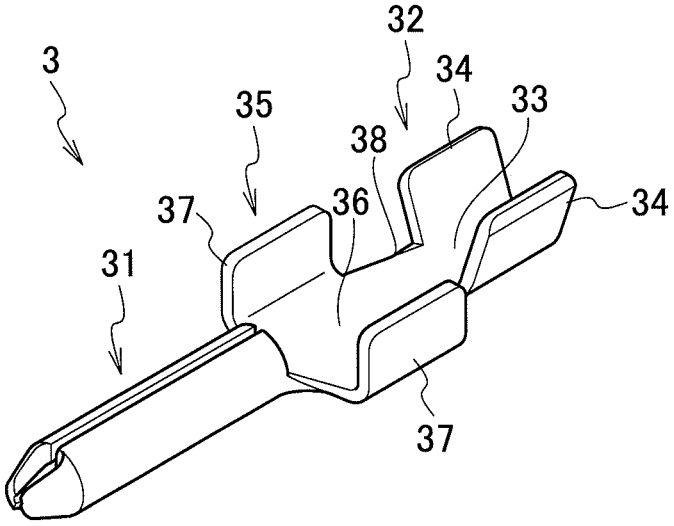
FIG. 2 is a perspective view showing an inner terminal in the shield connector according to the one embodiment of the present invention.

FIG. 2 shows the inner terminal 3, where an electric connecting portion 31 connected with an inner terminal 13 of the mating connector 11 is provided at a distal end side in an axial direction and a crimp barrel portion 32 connected with the core wire 21 of the shield electric cable 2 is provided at a base end side in the axial direction. The electric connecting portion 31 in a form of a tapered cylinder extends in the axial direction. By entering into and having a contact with the inner terminal 13 of the mating connector 11, the electric connecting portion 31 is conductive with the inner terminal 13 of the mating connector 11 (refer to FIG. 10). Thus, the shield connector 1 according to the embodiment is a male connector and the mating connector 11 is a female connector.

The crimp barrel portion 32 includes a bottom piece 33 and a pair of rectangular plate-like crimp pieces 34 rising from respective sides of the bottom piece 33. The crimp barrel portion 32 is formed into substantially U-shape having an open upper portion. The core wire 21 (of the shield electric cable 2) exposed by peeling off the inner cover 22 has its terminal contact the electric connecting portion 31 and inserted into the electric connecting portion 31. Further, a terminal portion following the terminal contacts the bottom piece 33 of the crimp barrel portion 32. Then, with the terminal portion contacting the bottom piece 33, the crimp pieces 34 are bent and crimped to the core wire 21, to thereby fix the core wire 21 to the inner terminal 3. The above summarizes that the core wire 21 of the shield electric cable 2 is fixed to the inner terminal 3 in an electrical connecting state with the inner terminal 3.

The inner terminal 3 is provided with an impedance adjusting portion 35. The impedance adjusting portion 35 is provided between the electric connecting portion 31 and the crimp barrel portion 32. Between the electric connecting portion 31 and the bottom piece 33 of the crimp barrel portion 32, the impedance adjusting portion 35 has a bottom plate portion 36 continuous with the electric connecting portion 31 and bottom piece 33. Further, the impedance adjusting portion 35 is formed into substantially U-shape having a pair of rectangular plate-like side plate portions 37 rising from respective sides of the bottom plate portion 36 in such a manner as to be substantially erect. In this case, the pair of side plate portions 37 are formed to be positioned in such a manner as to protrude more outward than the pair of crimp pieces 34 of the crimp barrel portion 32. That is, the bottom plate portion 36 is larger in width than the bottom piece 33 of the crimp barrel portion 32, and the pair of side plate portions 37 are provided on respective sides of the bottom plate portion 36 having the large width, thereby the rectangular plate-like side plate portions 37 are positioned more outward than the crimp pieces 34 of the crimp barrel portion 32. With the side plate portions 37 positioned outward as set forth above, the impedance adjusting portion 35 is mated with the inner housing 4 (a later-discussed mating groove portion 42 of the inner housing 4), thus allowing the impedance adjusting portion 35 to position the inner terminal 3 relative to the inner housing 4. Further, the side plate portion 37 of the impedance adjusting portion 35 is provided in a position adjacent, via a cutout portion 38, to the crimp piece 34 of the crimp barrel portion 32 on the base end side.

With respect to the impedance adjusting portion 35, the core wire 21 (of the shield electric cable 2) disposed from the electric connecting portion 31 to the crimp barrel portion 32 contacts the bottom plate portion 36, thus allowing the side plate portions 37 to surround the core wire 21 from right and left in this contact state. Thus, in a portion of forming the impedance adjusting portion 35, the impedance is lowered, and even if there is a portion having a high impedance at other portion of the shield connector 1, the impedance of the entirety of the shield connector 1 is adjusted to be averaged. This enables to improve the high frequency performance. Providing the impedance adjusting portion 35 at the inner terminal 3 dispenses with adding to the shield connector 1 other parts for averaging the impedance, thus preventing increase of the number of parts of the shield connector 1 as well as facilitating assembling of the shield connector 1.

The above inner terminal 3 is received in the inner housing 4, and the inner housing 4 receiving therein the inner terminal 3 is assembled into the outer terminal 5.

Figure 3:
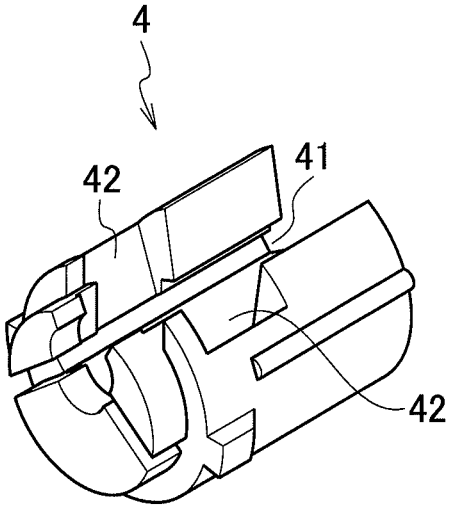
FIG. 3 is a perspective view showing an inner housing in the shield connector according to the one embodiment of the present invention.

As shown in FIG. 3, the inner housing 4 is formed to be substantially cylindrical extending in the axial direction. The inner housing 4 is formed with a receiving recess portion 41 along the axial direction. The receiving recess portion 41 has an upper portion opened, and the inner terminal 3 is dropped into the receiving recess portion 41 from the opened upper portion of the receiving recess portion 41. This dropping-in allows the inner terminal 3 to be received in the inner housing 4. With the inner terminal 3 received in the inner housing 4, the electric connecting portion 31 of the inner terminal 3 protrudes from a distal end of the inner housing 4 in a direction of a mating terminal 13, thus allowing the electric connecting portion 31 to have a contact with the mating terminal 13 (refer to FIG. 6 and FIG. 10).

The receiving recess portion 41 is formed with the mating groove portions 42. The mating groove portion 42 is rectangular and formed on each of both sides in the center portion in the longitudinal direction of the receiving recess portion 41. The side plate portion 37 of the impedance adjusting portion 35 mates with the mating groove portion 42. With the side plate portion 37 mated with the mating groove portion 42, the inner terminal 3 is fixed to the inner housing 4 in a state in which positioning of the inner terminal 3 relative to the inner housing 4 has been made. This can reliably receive the inner terminal 3 in a fixed position of the inner housing 4.

As shown in FIG. 1, the outer terminal 5 has such a structure as that a cylindrical portion 51, a terminal body portion 52 and a shield member connecting portion 53 are continuously formed from the distal end side to the base end side in the axial direction.

The shield member connecting portion 53 on the base end side has such a structure as that two combinations of a pair of rectangular plate-like crimp pieces 54 opposedly rising are formed along the longitudinal direction. The shield member connecting portion 53 fixes the shield member 23 (of the shield electric wire 2) which was exposed by peeling off the outer cover 24. This fixing is accomplished after the inner housing 4 receiving therein the inner terminal 3 is set at the terminal body portion 52, by crimping, with the crimp piece 54, the peeled-off shield member 23 getting out on the base end side of the inner housing 4. This operation brings the shield member 23 of the shield electric cable 2 into a conductive state with the outer terminal 5.

The terminal body portion 52 is positioned closer to the distal end side in the axial direction than to the shield member connecting portion 53 and has a pair of rectangular plate-like body pieces 55 opposedly rising. The inner housing 4 receiving therein the inner terminal 3 is incorporated into the terminal body portion 52 in such a manner as to be positioned between the body pieces 55. While the inner housing 4 being incorporated into the terminal body portion 52, the body pieces 55 covering the outside of the inner housing 4 on respective sides of the inner housing 4 so operate as to reduce the exposing amount of the inner housing 4.

Figure 5:
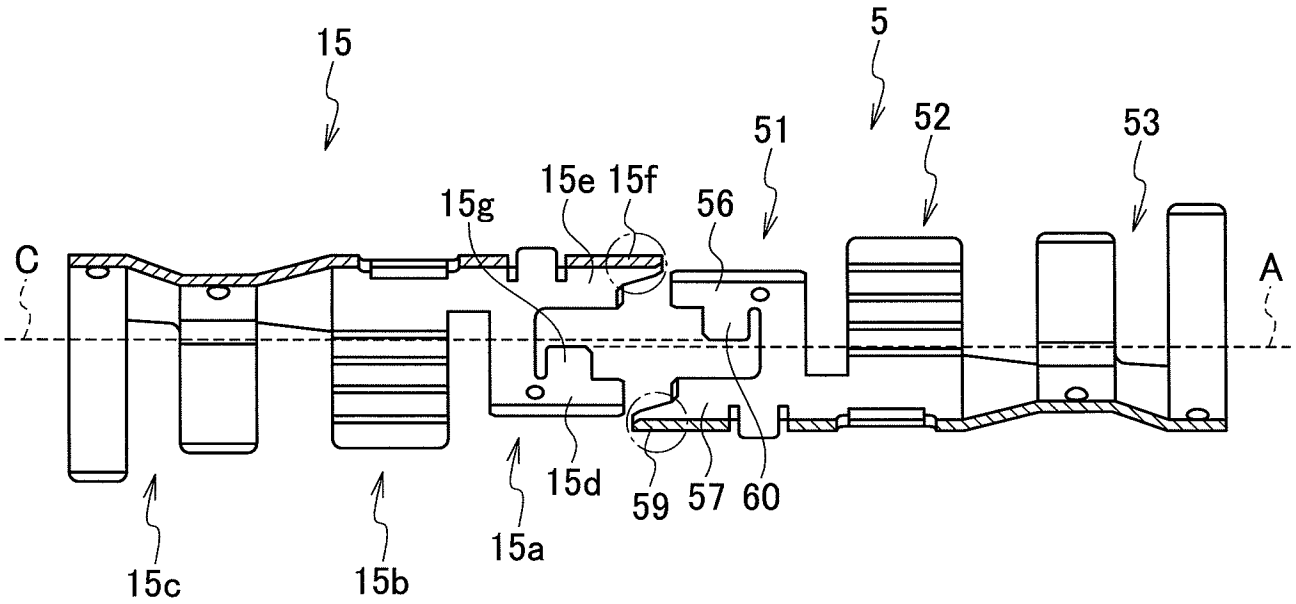
FIG. 5 is a cross sectional view showing an inner portion of the state in FIG. 4.
Figure 6:
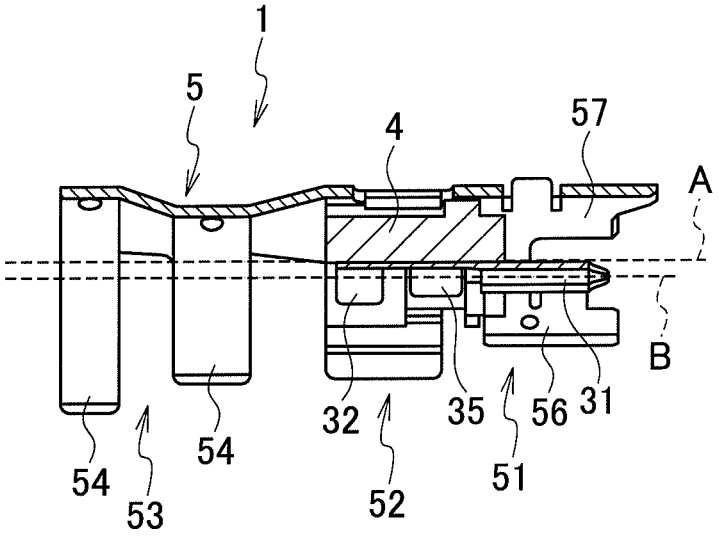
FIG. 6 is a cross sectional view for explaining connection of the shield connector with the mating connector.
Figure 7:
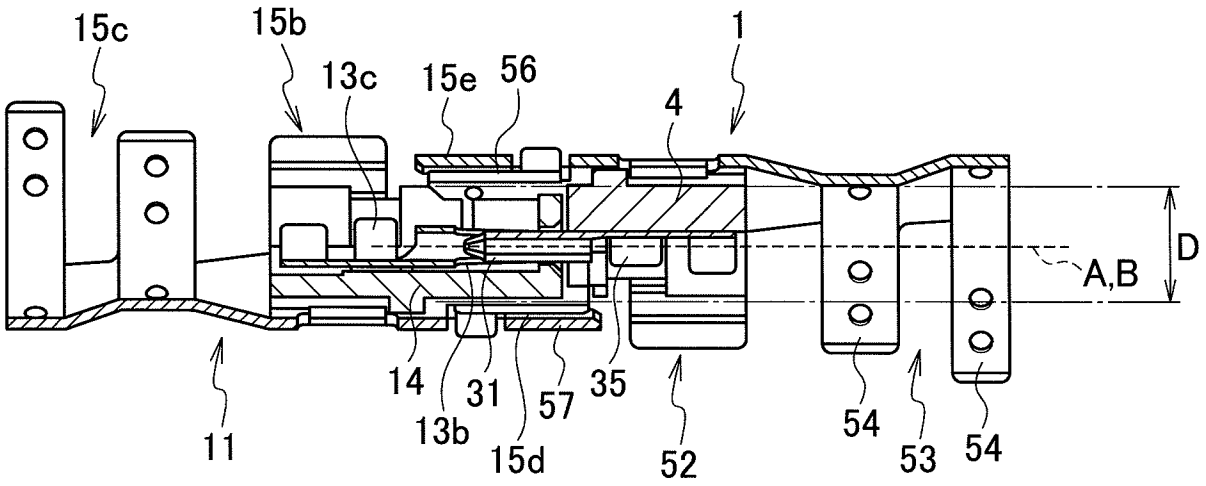
FIG. 7 is a cross sectional view for explaining connection of the shield connector with the mating connector.
Figure 8:
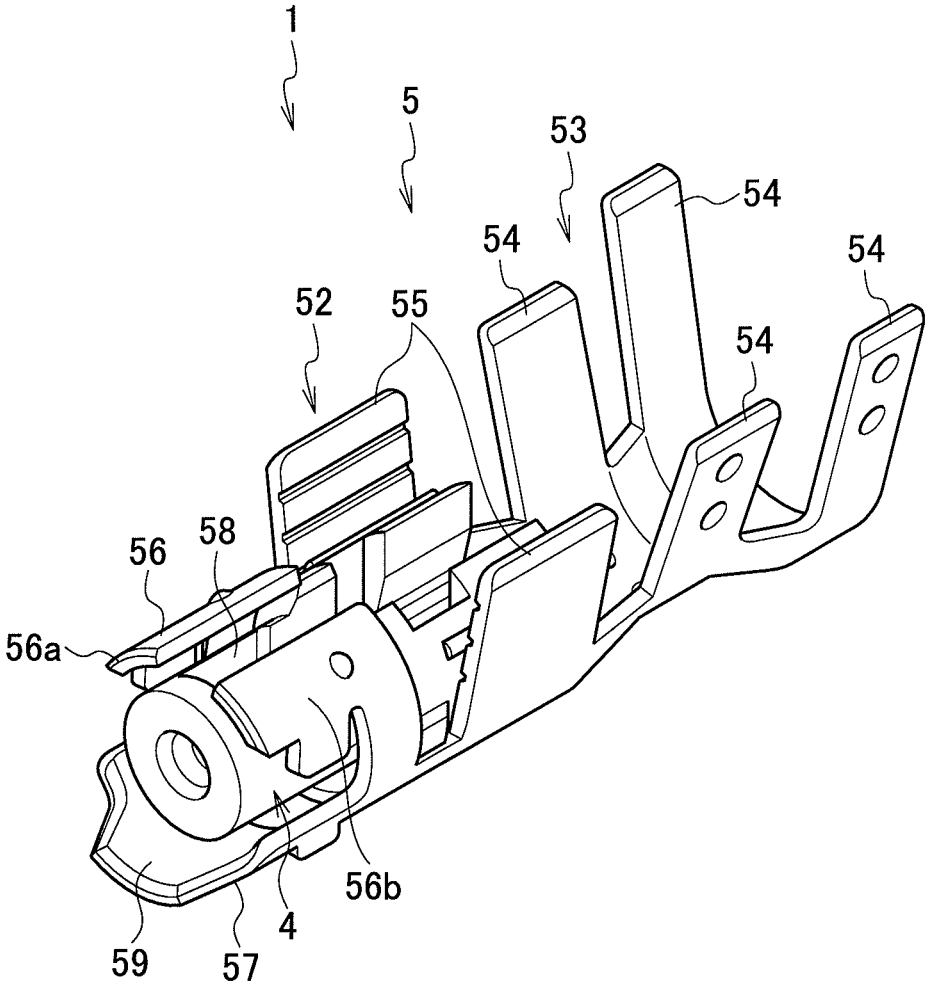
FIG. 8 is a perspective view showing a state in which the inner housing is set into the outer terminal in the shield connector, according to the one embodiment of the present invention.

The cylindrical portion 51, thus provided closer to the distal end side in the axial direction than the terminal body portion 52, is positioned on the mating connector side. The entirety of the cylindrical portion 51 has a cylindrical outer configuration, into which, as shown in FIG. 8, the substantially cylindrical inner housing 4 is inserted. Further, as shown in FIG. 6 and FIG. 10, the electric connecting portion 31 (of the inner terminal 3) getting out from the distal end of the inner housing 4 is positioned inside the cylindrical portion 51. As shown in FIG. 5, FIG. 7 and FIG. 10, the cylindrical portion 51 is mated with the mating connector 11, thus accomplishing connecting of the male and female connectors.

The cylindrical portion 51 is formed with a first semi-cylindrical wall 56 and a second semi-cylindrical wall 57, respectively, disposed in upper and lower positions. The first semi-cylindrical wall 56 is formed with a slit 58 along the longitudinal direction (refer to FIG. 1 and FIG. 8). Forming of the slit 58 brings the first semi-cylindrical wall 56 into a state of having two divided pieces 56*a*, 56*b*. In the above structure, an elasticity capable of sagging and recovering is given to each of the divided pieces 56*a*, 56*b*. With the elasticity given to the divided pieces 56*a*, 56*b*, the first semi-cylindrical wall 56 sags at the time of mating with the mating connector 11, thus enabling to easily mate the cylindrical portion 51 with the mating connector 11.

The second semi-cylindrical wall 57 in the lower position is so formed as to oppose the first semi-cylindrical wall 56 in the upper position. The second semi-cylindrical wall 57 has a distal end formed with a connector pick protrusion 59. The connector pick protrusion 59 operates to pick the mating connector 11 at the time of mating with the mating connector 11. This easily and reliably accomplishes the mating of the male and female connectors 1, 11.

Figure 9:
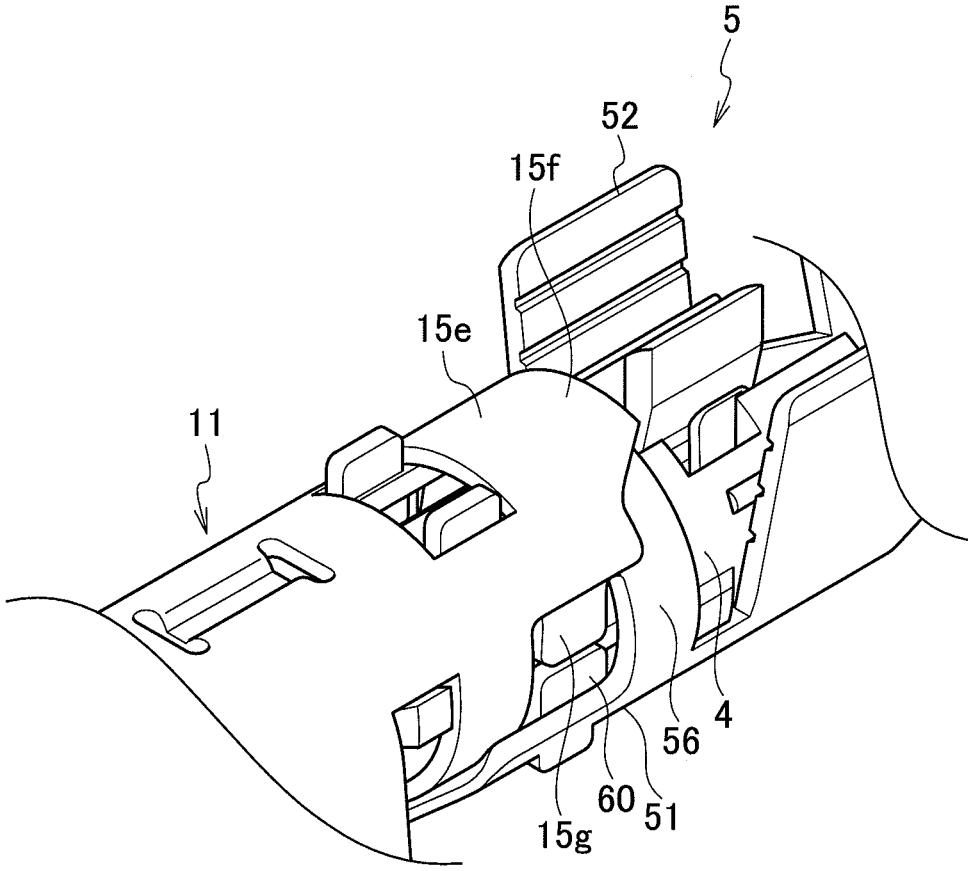
FIG. 9 is a perspective view showing a state in which the shield connector is connected with the mating connector, according to the one embodiment of the present invention.

In addition to the above, the cylindrical portion 51 is formed with a stopper portion 60 as shown in FIG. 5 and FIG. 9. The stopper portion 60 is so formed as to protrude, as a small piece, from the end face at each of the divided pieces 56*a*, 56*b* of the first semi-cylindrical wall 56. At the time of mating of the shield connector 1 with the mating connector 11, the stopper portion 60 is engaged with a stopper portion 15*g* of the mating connector 11. This engaging is so made as to prevent upward and downward deviation at the time of mating of the shield connector 1 with the mating connector 11.

The shield connector 1 having the above structure is a male connector. The shield connector 1 on this male side and the mating connector 11 on the female side are mated with each other, to thereby accomplish the connection between the connectors.

The mating connector 11 serving as the female connector is, like the shield connector 1, a shield connector and has the same configuration as that of the shield connector 1 on the male side. That is, the mating connector 11 has an inner terminal 13 having the same configuration as that of the inner terminal 3 of the shield connector 1 on the male side, an inner housing 14 having the same configuration as that of the inner housing 4 of the shield connector 1 on the male side, and an outer terminal 15 having the same configuration as that of the outer terminal 5 of the shield connector 1 on the male side.

As shown in FIG. 10, the inner terminal 13 of the mating connector 11 on the female side has a crimp barrel portion 13*a* connected to the core wire 21 by being crimped to the core wire 21 of the shield electric cable 2, an electric connecting portion 13*b* connected to the end of the core wire 21 and an impedance adjusting portion 13*c* having the same configuration as that of the impedance adjusting portion 35 of the shield connector 1 on the male side.

In this case, the electric connecting portion 31 of the shield connector 1 on the male side enters into the electric connecting portion 13*b*, to thereby bring the electric connecting portion 13*b* into contact with the electric connecting portion 31 of the shield connector 1 and make the electric connecting portion 13*b* conductive with the electric connecting portion 31. For allowing the above entry of the electric connecting portion 31, the electric connecting portion 13*b* is formed cylindrical. The impedance adjusting portion 13*c* is provided between the crimp barrel portion 13*a* and the electric connecting portion 13*b*. In the portion provided with the impedance adjusting portion 13*c*, the impedance is so operated as to be lower, like the shield connector 1 on the male side. This averages the impedance of the entirety of the mating connector 11, thus enabling to improve the high frequency performance of the mating connector 11, like the shield connector 1 on the male side. Like the inner housing 4 of the shield connector 1 on the male side, the inner housing 14 of the mating connector 11 receives therein the inner terminal 13. For receiving the inner terminal 13, like the shield connector 1 on the male side, the inner housing 14 is formed with a receiving recess portion (not shown). In the above receiving of the inner terminal 13, the cylindrical electric connecting portion 13*b* is brought into a state of protruding to the shield connector 1 side. Further, the inner housing 14 is formed with a mating groove portion (not shown) with which, like the shield connector 1 on the male side, the impedance adjusting portion 13*c* of the inner terminal 13 is mated to thereby position and fix the inner terminal 13.

The outer terminal 15 of the mating connector 11 has such a structure as that, as shown in FIG. 10, a cylindrical portion 15*a* having the same configuration as that of the cylindrical portion 51 of the shield connector 1 on the male side, a terminal body portion 15*b* having the same configuration as that of the terminal body portion 52 of the shield connector 1 on the male side, and a shield member connecting portion 15*c* having the same configuration as that of the shield member connecting portion 53 of the shield connector 1 on the male side are continuously formed along the axial direction. The inner housing 14 receiving therein the inner terminal 13 is assembled into the terminal body portion 15*b*, and the shield member connecting portion 15*c* is crimped and connected with the shield member 23 which is exposed by peeling off the outer cover 24. The cylindrical portion 51 of the tapered shield connector 1 on the male side is mated with the cylindrical portion 15*a*. As shown in FIG. 5, like the cylindrical portion 51 of the shield connector 1 on the male side, the cylindrical portion 15*a* is formed with a first semi-cylindrical wall 15*d* given an elasticity capable of sagging by forming a slit (not shown) and a second semi-cylindrical wall 15*e* disposed in the upper portion and opposing the first semi-cylindrical wall 15*d* disposed in the lower portion. Further, a distal end of the second semi-cylindrical wall 15*e* is formed with a connector pick protrusion 15*f* like the connector pick protrusion 59 on the shield connector side. The first semi-cylindrical wall 15*d* is formed with the stopper portion 15*g* like the stopper portion 60 on the shield connector 1 side.

The above outer terminal 15 of the mating connector 11 has the same configuration as that of the outer terminal 5 of the shield connector 1 on the male side and can be shared between the mating connector 11 and the shield connector 1. In this case, the mutual mating is implemented with the male and female connectors 1, 11 vertically reversed relative to each other. That is, in the mating connector 11 on the female side, the outer terminal 15 is set upside down relative to the outer terminal 5 of the shield connector 1 on the male side, and the outer terminal 15 is mated with the outer terminal 5 of the shield connector 1 on the male side in this upside-down state (refer to FIG. 4 and FIG. 5).

As stated above, making the structure such that the outer terminals 5 and 15 mutually mated have the same configuration and can be mated in the upside-down state allows the outer terminals 5, 15 to be shared between the male shield connector 1 and the female mating connector 11. Due to this, it is not necessary to make the outer terminals 5, 15 in different configurations for mutual mating, thus eliminating the need of producing the outer terminals 5, 15 in different configurations. This eliminates the need of separately preparing metal molds for production, thus enabling to reduce the production cost.

Next, an explanation will be given on mating and thereby connecting the male shield connector 1 and the female mating connector 11.

FIG. 6 shows the inside of the shield connector 1 on the male side before the mating. The inner housing 4 receiving therein the inner terminal 3 is incorporated into the outer terminal 5. Before the mating as shown in FIG. 6, a center axis A (upper) of the outer terminal 5 is deviated from a center axis B (lower) of the inner terminal 3.

FIG. 5 shows a confronting state for mating the male shield connector 1 with the female mating connector 11. The confronting is implemented with the outer terminal 15 of the mating connector 11 on the female side in an upside-down state relative to the outer terminal 5 of the shield connector 1 on the male side. That is, the confronting is so implemented that the first semi-cylindrical wall 56 of the cylindrical portion 51 of the shield connector 1 on the male side is caused to face the second semi-cylindrical wall 15*e* of the cylindrical portion 15*a* of the mating connector 11 on the female side, and the second semi-cylindrical wall 57 of the cylindrical portion 51 of the shield connector 1 on the male side is caused to face the first semi-cylindrical wall 15*d* of the cylindrical portion 15*a* of the mating connector 11 on the female side.

In this case, the confronting is implemented by deviating upward and downward the center axes A, C of the outer terminals 5, 15 each by an amount equivalent to a plate thickness of one of the respective cylindrical portions 51, 15*a*. Then, the male shield connector 1 is mated with the female mating connector 11 in this state. In this case, the connector pick protrusion 59 in the second semi-cylindrical wall 57 of the cylindrical portion 51 of the connector 1 on the male side picks the first semi-cylindrical wall 15*d* of the cylindrical portion 15*a* of the mating connector 11 on the female side and the connector pick protrusion 15*f* in the second semi-cylindrical wall 15*e* of the cylindrical portion 15*a* of the mating connector 11 on the female side picks the first semi-cylindrical wall 56 of the cylindrical portion 51 of the shield connector 1 on the male side, to thereby implement the mating. This enables to easily and reliably mate the male shield connector 1 with the female mating connector 11.

With the above mating, the first semi-cylindrical wall 56 of the shield connector 1 on the male side is positioned inside the second semi-cylindrical wall 15*e* in the outer terminal 15 of the mating connector 11 on the female side while the first semi-cylindrical wall 15*d* in the outer terminal 15 of the mating connector 11 on the female side is positioned inside the second semi-cylindrical wall 57 of the shield connector 1 on the male side. This allows the center axes A, C of the respective outer terminals 5, 15 to coincide coaxially. Further, the mating of the male shield connector 1 with the female mating connector 11, as shown in FIG. 7, allows that, in the shield connector 1 on the male side, the center axis B of the inner terminal 3 coincides with the center axis A of the outer terminal 5 (center of an inner diameter D of the outer terminal 5). Since the center axes B and A coincide with each other at the time of the mating, the high frequency performance of the shield connector 1 on the male side can be maintained.

Figure 4:
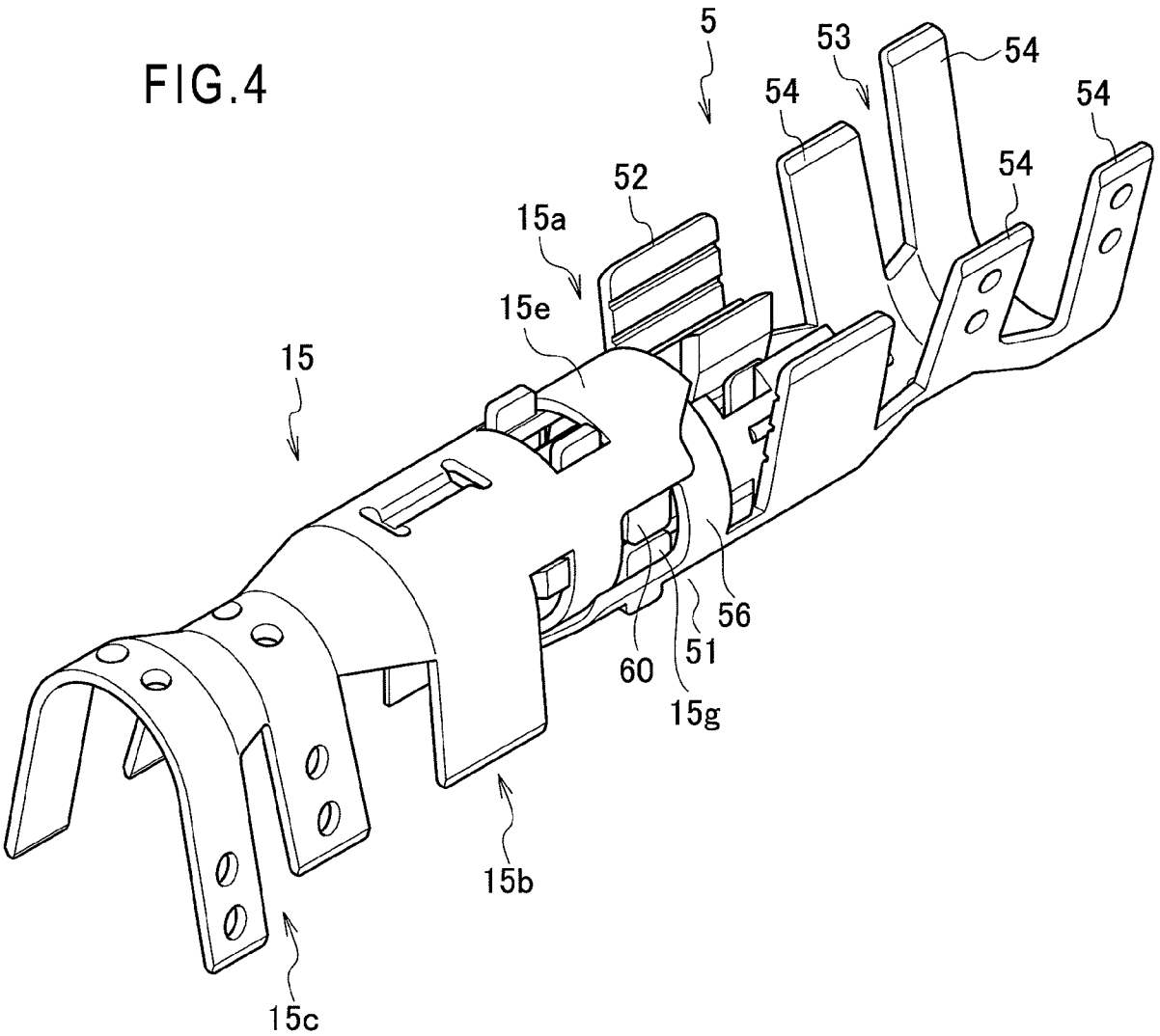
FIG. 4 is a perspective view showing a state in which an outer terminal of the shield connector is connected with an outer terminal of a mating connector side, according to the one embodiment of the present invention.

FIG. 4 and FIG. 9 show a state in which the outer terminals 5, 15 of the respective male shield connector 1 and female mating connector 11 are mated by vertically reversing the outer terminals 5, 15, as described above. In the mating state of the outer terminals 5, 15, the stopper portions 60, 15*g* formed at the respective cylindrical portions 51, 15*a* are engaged with each other, thus enabling to prevent upward and downward deviations of the outer terminals 5, 15. Thus, the accuracy of mating state can be maintained.

In addition to this, the slits formed at the first semi-cylindrical walls 56, 15*d* of the respective cylindrical portions 51, 15*a* are covered with the mating second semi-cylindrical walls 15*e*, 57 mated with the first semi-cylindrical walls 56, 15*d*. Thus, the high frequency performance can be maintained despite the formation of the slits.

FIG. 10 shows the state in which the cylindrical portions 51, 15*a*, respectively, at the shield connector 1 on the male side and the mating connector 11 on the female side are mated with each other. In each of the male shield connector 1 and the female mating connector 11, the open portion is formed at the shield member 23 portion of the shield electric cable 2, to thereby enhance the impedance in the shield member 23 portion (portion M in FIG. 10). However, in the connectors 1, 11, the impedance adjusting portions 35, 13*c* are formed at the inner terminals 3, 13, thus acting to lower the impedance near the portion M where the impedance is enhanced (portion N in FIG. 10). With this, the entire impedance can be averaged, thus enabling to improve the high frequency performance. Increasing and decreasing the area of the above impedance adjusting portion 35 can adjust the impedance adjusting amount, thus enabling to easily adjust the impedance.

As explained above, according to the embodiment, the impedance adjusting portion 35 for improving the high frequency performance by averaging the impedance is provided at the inner terminal 3, thus eliminating the need of additional parts for averaging the impedance. Thus, it is possible to adjust the impedance with a simple structure without increasing the number of parts, thus making it easy to assemble the shield connector 1.

Further, mating the impedance adjusting portion 35 of the inner terminal 3 with the mating groove portion 42 of the inner housing 4 positions the inner terminal 3, thus making it easy to position the inner terminal 3.

Further, the impedance adjusting portion 35 is formed with the bottom plate portion 36 and the side plate portions 37 rising from the bottom plate portion 36, thus simplifying the structure, to thereby enable to form the impedance adjusting portion 35 with ease.

According to the embodiment, the inner terminal 13, inner housing 14 and outer terminal 15 of the mating connector 11 on the female side are the same in configuration as the inner terminal 3, inner housing 4 and outer terminal 5 of the shield connector 1 on the male side. However, the above members may have different configurations. In this case, for improving the high frequency performance of the mating connector 11 on the female side, besides the shield connector 1 on the male side, the impedance adjusting portion 13*c* is to be formed at the mating connector 11 on the female side.

What is claimed is:

1. A shield connector to be connected to an end of a shield electric cable having a core wire covered with a shield member via insulation, the shield connector comprising:

an inner terminal including a crimp barrel portion with which an end of the core wire is connected and an electric connecting portion to be electrically connected with a mating terminal;

an insulation inner housing to receive therein the inner terminal;

an outer terminal including a terminal body portion into which the inner housing is set with the inner terminal received in the inner housing, a shield member connecting portion with which the shield member is connected, and a cylindrical portion in which the electric connecting portion of the inner terminal is positioned, the cylindrical portion mated with a mating connector; and an impedance adjusting portion provided between the electric connecting portion and the crimp barrel portion of the inner terminal, wherein the impedance adjusting portion and the inner terminal form a unitary piece.

2. The shield connector according to claim 1, wherein the inner housing is formed with a receiving recess portion to receive the inner terminal, the receiving recess portion is formed with a mating groove portion, and mating the impedance adjusting portion with the mating groove portion enables to position the inner terminal to the inner housing.

3. The shield connector according to claim 1, wherein the impedance adjusting portion is formed with a bottom plate portion continuous with the electric connecting portion and the crimp barrel portion, and side plate portions rising from respective side portions of the bottom plate portion.

4. The shield connector according to claim 2, wherein the impedance adjusting portion is formed with a bottom plate portion continuous with the electric connecting portion and the crimp barrel portion, and side plate portions rising from respective side portions of the bottom plate portion.

5. The shield connector according to claim 1, wherein the outer terminal only partially encloses the inner terminal.

6. The shield connector according to claim 1, wherein the inner housing only partially encloses the inner terminal.

* * * * *